US007080753B1

(12) United States Patent
Miller

(10) Patent No.: US 7,080,753 B1
(45) Date of Patent: Jul. 25, 2006

(54) COLLAPSIBLE HANDLE FOR DISPOSABLE CUPS

(75) Inventor: Kenneth Miller, Maple Valley, WA (US)

(73) Assignee: Pacific Market International, Inc., Seattle, WA (US)

( * ) Notice: Subject to any disclaimer, the term of this patent is extended or adjusted under 35 U.S.C. 154(b) by 218 days.

(21) Appl. No.: 10/454,057

(22) Filed: Jun. 3, 2003

(51) Int. Cl.
*B65D 25/00* (2006.01)

(52) U.S. Cl. ..... 220/737; 220/666; 220/758

(58) Field of Classification Search ..... 220/4.28, 220/6, 324, 666, 737, 738, 739, 741, 758, 220/771, 908.1; 229/111, 117.19, 117.23, 229/402, 403, 405; 16/422, 425; 294/151, 294/152, 153, 169
See application file for complete search history.

(56) References Cited

U.S. PATENT DOCUMENTS

| | | | | |
|---|---|---|---|---|
| 2,936,927 | A * | 5/1960 | Peters | 220/737 |
| 4,211,033 | A * | 7/1980 | Ringer | 47/45 |
| 6,347,810 | B1 * | 2/2002 | Dottel | 281/29 |
| 6,364,151 | B1 * | 4/2002 | Gale | 220/738 |

* cited by examiner

*Primary Examiner*—Nathan J. Newhouse
*Assistant Examiner*—Harry Grosso
(74) *Attorney, Agent, or Firm*—Black Lowe & Graham PLLC

(57) ABSTRACT

The present invention provides a collapsible cup holder 10 having a plurality of hinges 12 intercoupling a plurality of rigid panels 14 and a handle 16 to form a collapsible ring 18. When the ring 18 is in an open position, the cup holder 10 can receive and retain a disposable container. When the ring 18 is in a closed position, the size of the holder 10 is reduced. The ring 18 is uniquely collapsible to provide an exposed, rigid panel surface that can be used to prominently display a decorative feature.

15 Claims, 4 Drawing Sheets

COLLAPSIBLE HANDLE FOR DISPOSABLE CUPS

BACKGROUND OF THE INVENTION

1. Field of the Invention

The invention relates generally to apparatus for holding a disposable container. More specifically, the invention relates to apparatus and methods for selectively holding a disposable container such as a conical beverage container with a collapsible holder.

2. Description of the Related Art

Disposable cups of the well known paper and styrofoam type have been available for many years and are preferred by vendors of hot and cold beverages in a take out environment. These vendors have realized that holding a hot or cold disposable cup may be uncomfortable for the customer and have therefore provided a variety of cup holders (with and without handles) to mitigate thermal, mechanical, or other user discomfort. Cup holders of the prior art (both disposable and otherwise) vary greatly in size and configuration. For example, some are molded of a bulky insulating material for the purpose of keeping a hot beverage hot, or a cold beverage cold. These types of cup holders, while extremely thermally effective, are disadvantageously generally about the same height as the container they are designed to hold. An example of a typical cup holder of this type is disclosed by Effertz in U.S. Pat. No. 5,147,067 issued Sep. 15, 1992. Other disposable cup holders consist of a ring design, wherein a ring surrounds a disposable cup's outer circumference to keep a user's hands from being in direct contact with a hot or cold container in one of two ways. Some prior art ring designs have a handle with which to lift the disposable container and thereby keep the user's hands from surrounding the outer surface of the container. See U.S. Pat. No. 4,685,583 to Noon; U.S. Pat. No. 5,868,310 to Leszczynski; and U.S. Pat. No. 3,481,639 to Lawrence. Yet other well known prior art ring designs consist of only the ring, wherein the ring itself is used as a sleeve barrier to protect the user's hand from hot or cold temperatures. Although some of the prior art ring designs may collapse into a smaller size for ease of storage (prior to use), none of these prior art ring designs provide for a collapsible cup holder that is well adapted for aesthetically displaying an advertisement on a flat rigid portion of the ring when the cup holder is reduced in size.

For example, U.S. Pat. No. 5,868,310 to Leszczynski is directed toward a beverage container holder having a flexible collar and a handle. The collar is movable between a first shape and a second shape. The first shape defines a cup opening to hold a disposable cup and the second shape is a folded shape to reduce the size of the collar. In one embodiment, the Leszczynski collar is made of nylon or other fabric, and thus the collar can be reduced in size by wrapping the flexible form around the handle. The wrinkles and creases that are characteristic of flexible nylon or other flexible materials create an uneven surface that is not suitable for display of advertising materials.

In another example, U.S. Pat. No. 4,685,583 to Noon is directed toward a disposable cup holder that forms a whole handle from two handle halves that are attached to opposite ends of a strip. When the two handle halves are assembled, the strip connecting each handle half forms a ring to hold a disposable cup. However, once the Noon invention is assembled, the resulting ring is not collapsible. Thus, while the Noon invention is initially flat, and thereby allows several pre-assembled cup holders to be conveniently stacked in a space-saving manner prior to assembly, the Noon cup holder is not readily reducible in size after each use for repeated use by a customer.

As a result, there is a need for a cup holder that is conveniently reducible in size after each use, and capable of prominently displaying an advertisement on a flat rigid surface when not in use.

BRIEF SUMMARY OF THE INVENTION

It is therefore an object of the present invention to provide a reusable cup holder for disposable cups that is easily reducible in size when not in use. It is a further object of the invention to achieve the above object while providing a flat rigid surface suitable for displaying advertisements or other information when the cup holder is in its reduced position.

These objects, and other objects and advantages of the invention, which will become apparent from the description which follows, are achieved by providing a collapsible cup holder having a plurality of hinges intercoupling a plurality of rigid panels, and a handle, to form a collapsible ring. When the ring is in an open position, the cup holder can receive and retain a disposable container. When the ring is in a closed position, the size of the holder is reduced and at least one panel is visible for displaying an advertisement or the like. In the alternative, the structure of the panel itself may be ornamental.

In the preferred embodiment, when the ring is in the open position, at least some of the hinges are skewed with respect to one another so that a top inner diameter of the ring is larger than a bottom inner diameter of the ring. In this way, when a disposable conical cup is placed within the open ring, the cup is retained within the ring because a portion of a circumferential outer wall of the conical cup makes contact with a portion of the bottom inner diameter of the ring and thereby provides an interference fit.

When the ring of the invention is in a closed position, a longitudinal base of the handle is adjacent to an opposing panel, and opposed lateral surfaces of the handle reside adjacent to at least a first and a second rigid panel. An outer surface of a third rigid panel and an outer surface of a fourth rigid panel provide a flat rigid surface that is visible and capable of prominently displaying decorative features or commercial advertisements when the collapsible cup holder is reduced in size. In an alternate embodiment, the hinges are parallel to one another so that the ring's top inner diameter is substantially the same size as the ring's bottom inner diameter. The size of the ring's inner diameter is preselected such that the ring's top and bottom inner diameters are larger than a bottom circumferential outer wall of a conical disposable cup, yet smaller than a top circumferential outer wall of the conical cup. In this way, when the cup is placed within the ring of this embodiment, the ring allows a lower portion of the cup to enter through the top inner diameter of the ring, and the ring retains the cup when a portion of the outer wall of the conical cup makes contact with a portion of the smaller top inner diameter of the ring.

BRIEF DESCRIPTION OF THE SEVERAL VIEWS OF THE DRAWINGS

In the drawings, the sizes and relative positions of elements are not necessarily drawn to scale. For example, the shapes of various elements and angles are not drawn to scale, and some of these elements are arbitrarily enlarged to improve drawing legibility.

DETAILED DESCRIPTION OF THE INVENTION

Figure 1:
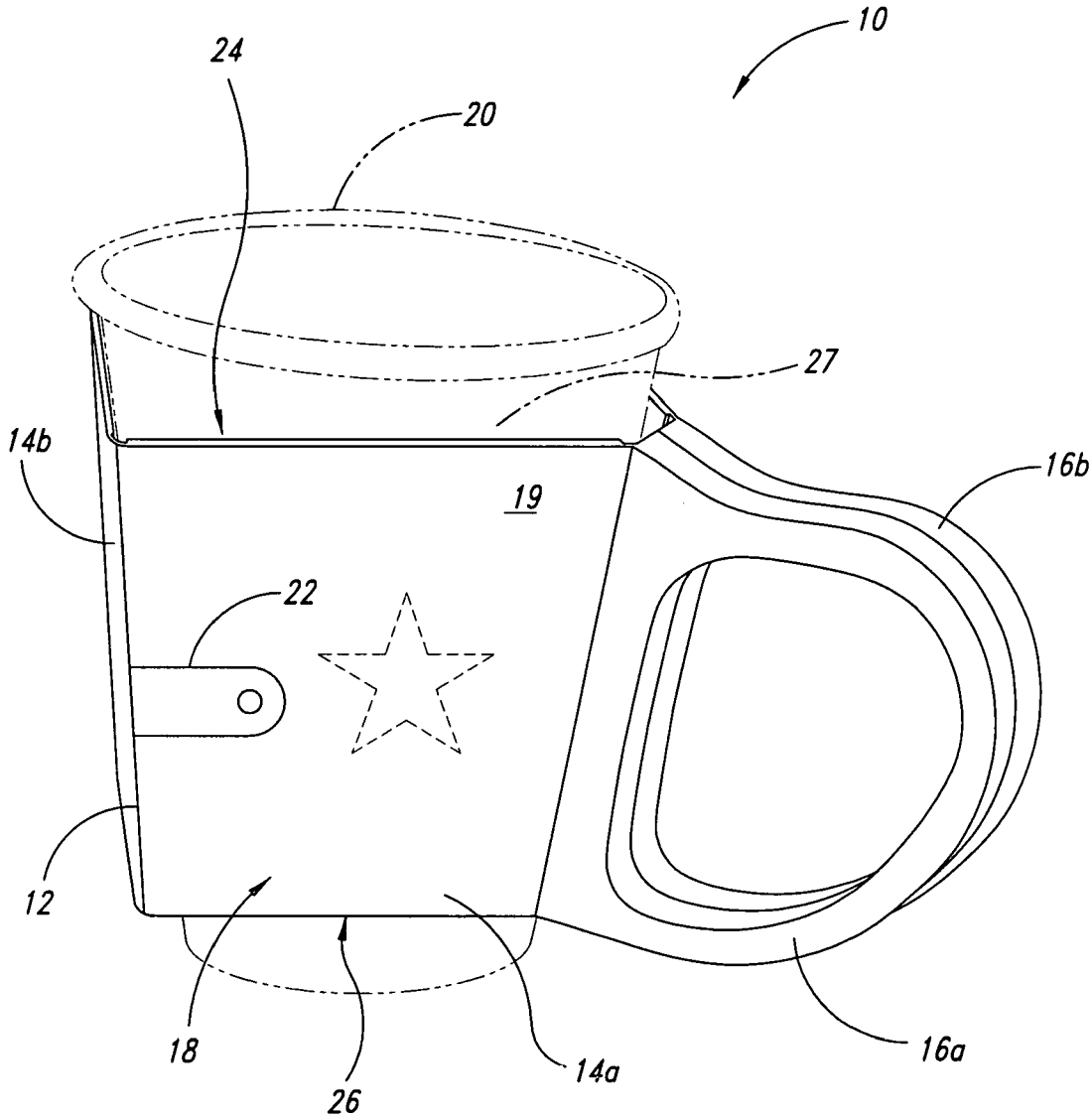
FIG. 1 is a left front perspective view of a collapsible cup holder provided in accordance with one embodiment of the present invention, illustrated in an assembled, open, in-use position.

A preferred embodiment of a cup holder, in accordance with the principles of the invention, is generally indicated at reference numeral 10 in the Figures. The cup holder 10 has a plurality of hinges 12 intercoupling a plurality of rigid panels 14 and a handle 16 to form a collapsible ring 18. When the ring 18 is in an open position, the cup holder 10 can receive and retain a disposable container 20 shown in phantom lines. When the ring 18 is in a closed position (the cup having been previously removed), the size of the holder 10 is reduced for storage and re-use. The ring 18 is uniquely collapsible to provide an exposed, rigid panel surface (generally indicated at reference number 19) that can be used to prominently display a decorative feature shown in phantom lines.

FIG. 1 shows one preferred embodiment of the present invention in an assembled, in-use position. That is, the ring 18 of the disposable cup holder 10 is shown in an open position. The hinges 12 of the disposable cup holder 10 enable the panels 14 and handle 16 to pivot with respect to one another, thereby allowing the ring 18 to collapse to a reduced size, seen in FIG. 5, when the cup holder 10 is not in use. A latch 22 is optionally provided to maintain the cup holder 10 in its reduced size when the holder 10 is not in use. In this preferred embodiment, four polygonal panels 14*a*, 14*b*, 14*d* and 14*e* (see FIG. 2) have a trapezoidal shape with top and bottom edges 15*a*, 15*b*, 15*d* and 15*e* being parallel to one another. Further, the hinges 12*a*, 12*b*, 12*d*, 12*e*, and 12*f* are skewed to one another, thereby providing a larger top inner diameter 24 of the ring 18 than a bottom inner diameter 26 of the ring 18 when the ring 18 is in the open position. An intermediate panel 14*c* has parallel hinges 12*c*, 12*d* for reasons that will be apparent further below. In this way, when a conical disposable cup 20 is placed within the open ring 18, the ring 18 retains the cup 20 when a portion of a circumferential outer wall 27 of the conical cup 20 makes contact with a portion of the bottom inner diameter 26 of the ring 18. As will be understood by one of ordinary skill in the art, other panel shapes (or combination of shapes), such as triangles or triangles in combination with trapezoids, may also be used while still maintaining the skewed (i.e., non-parallel) relationship of the hinges 12*a*, 12*b*, 12*d*, 12*e*, and 12*f* to obtain a smaller bottom inner diameter 26, as compared to the top inner diameter 26, of the ring 18.

Figure 2:
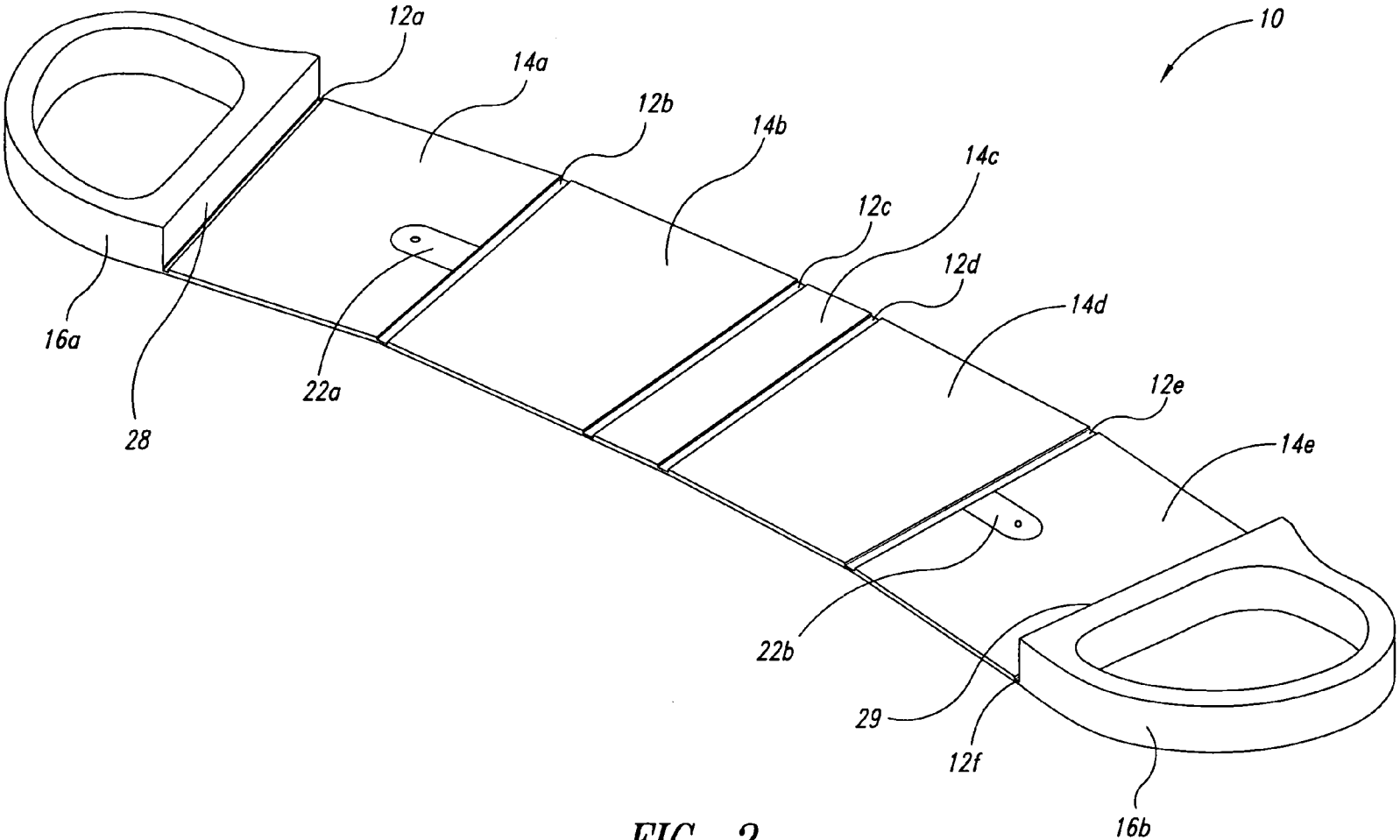
FIG. 2 is a front perspective view of the collapsible cup holder of FIG. 1, illustrated in an unassembled, laid-out position.

FIG. 2 shows a laid-out view of the cup holder 10 of FIG. 1, prior to final assembly. This embodiment has five rigid panels 14*a*–14*e*. Further, the handle 16 is comprised of two handle halves, 16*a* and 16*b*, having a conventional cup handle shape, with each handle half 16*a*, 16*b* pivotally connected to the panel 14 by hinges 12*a*, 12*f*, respectively. The first half 16*a* of the handle 16 has a first side edge 28 connected to the first panel 14*a* by hinge 12*a*, and the second half 16*b* of the handle 16 has a second side edge 29 connected to the second panel 14*e* by hinge 12*f*. The handle 16 may be made of any rigid material that is sufficiently strong to support the ring 18 and a cup retained therein when the ring is in the open position. Suitable materials for constructing the handle 16 include metal, wood, or heavy cardboard. In the preferred embodiment, the handle 16, panels 14, and hinges 12 are all made of an injection molded thermoplastic material such as Acrylonitrile Butadiene Styrene (ABS). ABS is a rigid, relatively inexpensive, lightweight polymer, which can be easily molded into a comfortable shape for holding the handle 16 with one hand.

FIG. 2 shows that the panels 14 are preferably injection molded from a singular piece of ABS material, and that the hinges 12*a*–12*f* are thus living hinges. The term "living hinge" refers to a hinge construction made of the same integrated material as each of the panels 14, but having a thinner thickness than the rest of the material 28, thereby allowing the material 28 to bend at the location of each hinge 12. Thus, living hinge 12*a* pivotally connects the longitudinal edge of the first handle half 16*a* to a first longitudinal edge of panel 14*a*, living hinge 12*b* pivotally connects a second longitudinal edge of panel 14*a* to a first longitudinal edge of panel 14*b*, living hinge 12*c* pivotally connects a second longitudinal edge of panel 14*b* to a first longitudinal edge of rectangular panel 14*c*, living hinge 12*d* pivotally connects a second longitudinal edge of rectangular panel 14*c* to a first longitudinal edge of panel 14*d*, and living hinge 12*e* pivotally connects a second longitudinal edge of panel 14*d* to a first longitudinal edge of panel 14*e*. Finally, living hinge 12*f* pivotally connects a second longitudinal edge of panel 14*e* to the longitudinal edge of the second handle half 16*b*.

In FIG. 2, scoring used to create each living hinge is shown on an inner side of the ring 18. By placing all of the notches used to form each living hinge on one side of the ring, all of the scoring may be machine manufactured in a cost effective manner. However, as will be understood by one of ordinary skill in the art, depending on the type of material 28 used, it may be desirable to score each side of the material 28 at the location of each (or at a select few) living hinge 12 to enhance the flexing capabilities of the hinge 12. As will be understood by one of ordinary skill in the art, the living hinges 12 discussed herein provide just one means in which to intercouple the panels 14 and each handle half 16*a*, 16*b* to form the ring 18. A variety of other hinge-types, such as a projection and/or a parliament hinge, which, as will be understood by those of ordinary skill in the art, allow a hinged object to pivot up to 180°, may also be used.

FIG. 2 further shows that the latch 22, which is selectively used to maintain the cup holder's 10 reduced size when the ring 18 is in a closed position, has a first end 22*a* coupled to a first panel (in this instance, shown as panel 14*a*) and a second end 22*b* coupled to a second panel (in this instance, shown as panel 14*e*). However, as will be understood by one of ordinary skill in the art, a latch mechanism may be coupled to one or more panel 14, or to one or more hinge 12, through a variety of coupling means. In addition, the latching function may be achieved in a variety of ways. For example, the latch mechanism may consist of a hook that secures into a countering eye, or simply a string used to selectively tie the ring 18 to secure its closed position when the cup holder 10 is reduced in size.

Figure 3:
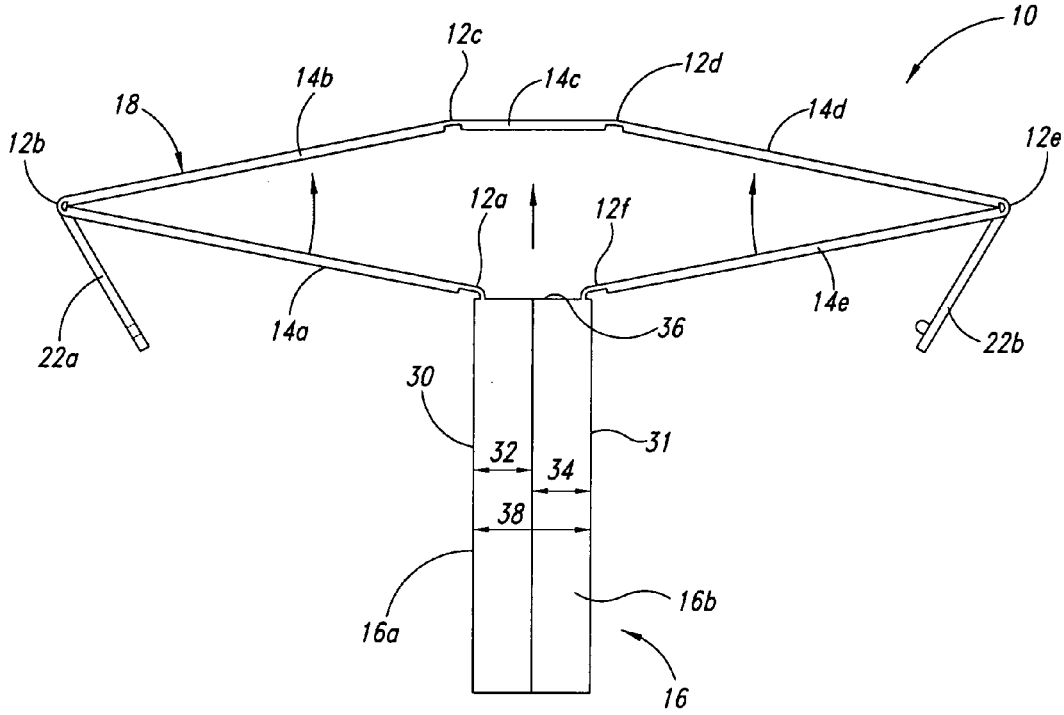
FIG. 3 is a top plan view of the collapsible cup holder of FIG. 1, illustrated in an assembled, partially closed position.
Figure 4:
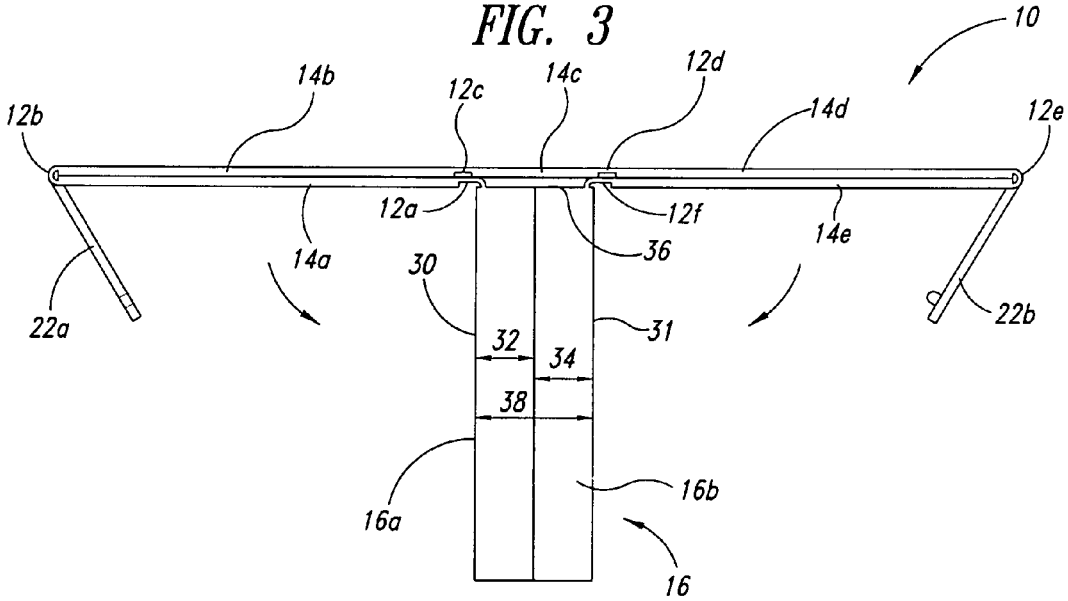
FIG. 4 is a top plan view (similar to FIG. 3) of the collapsible cup holder of FIG. 1, in which the cup holder is illustrated in a further partially closed position.

FIGS. 3 and 4 show the configuration of the handle 16 when the two handle halves, 16*a*, 16*b* are fastened together (such as by thermoplastic welding or an adhesive such as cyanoacrylate) to form the cup holder's 10 final assembled configuration. As these figures show, a lateral width 32, 34 of each handle half 16*a*, 16*b*, is preselected such that an overall lateral width 38 of the handle is substantially equal to, but preferably slightly smaller than the width of rectangular panel 14*c* (so as to accommodate the thickness of panels 14*a*, 14*b*, 14*d* and 14*e*). As further discussed below, such a configuration allows the hinges 12*c*, 12*d* of panel 14*c* to fold about the handle 16 when it is desired to reduce the size of the cup holder 10 in a book-like fashion. When the cup holder 10 is in its final assembled position, as shown in FIGS. 1, 3, 4 and 5, the handle 16 has opposed, parallel lateral surfaces 30, 31 and, due to each of the living hinges 12*a*–12*f*, which allow each panel 14*a*–14*e* and the handle 16 to selectively pivot, the ring 18 can be selectively moved to an open position to receive and retain a disposable cup, and to a closed position (after removal of the cup) to reduce the size of the holder 10.

FIGS. 3 and 4 also illustrate a choreography of the various panels 14 and hinges used to close and secure the ring 18 of the cup holder 10. When the handle 16 of the assembled ring 16 is pushed toward opposing panel 14*c*, as shown in FIG. 3, the handle's 16 hinges 12*a*, 12*f* pivot to allow a longitudinal base 36 of the handle 16 to be positioned adjacent to the longitudinal edges of opposing panel 14*c*. Further, hinges 12*b* and 12*e* pivot to allow panels 14*a* and 14*e* to be positioned adjacent to panels 14*b* and 14*d*, respectively.

FIG. 4 best shows that because the lateral width 32, 34 of each handle half 16*a*, 16*b* is substantially equal to, but preferably slightly smaller than, the width of the rectangular panel 14*c* (so as to accommodate the thickness of panels 14*a*, 14*b*, 14*e*, 14*d*), hinges 12*a* and 12*c* allow each of the adjacent panels 14*a* and 14*b* to pivot toward the first lateral surface 30 of the handle 16. Similarly, hinges 12*f* and 12*d* allow each of the adjacent panels 14*e* and 14*d* to pivot toward the second lateral surface 31 of the handle 16.

Figure 5:
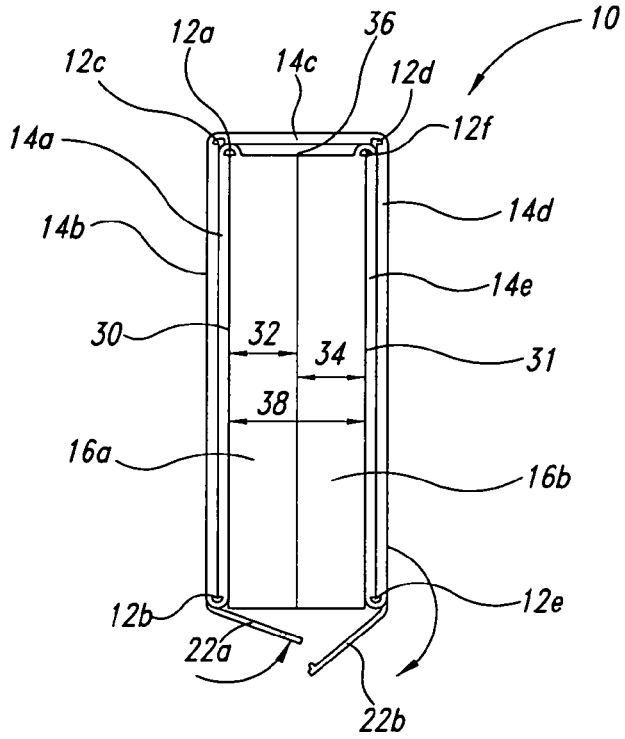
FIG. 5 is a top plan view of the collapsible cup holder of FIG. 1, illustrated in a closed position

FIG. 5 shows the collapsible cup holder 10 of the invention in its fully reduced position. In this position, an inner surface of panel 14*a* is adjacent to the first lateral surface 30 of handle 16 and an outer surface of panel 14*b* is an exposed surface. In addition, an inner surface of panel 14*c* is adjacent to the second lateral surface 31 of handle 16 and an outer surface of panel 14*d* is an exposed surface. A decorative feature or advertisement scaled to fit within the dimensions of the outer surfaces of panels 14*b* and 14*d* may be applied thereto because the outer surfaces of panels 14*b* and 14*d* are visible when the cup holder 10 is in its reduced position. When the cup holder 10 is in its fully closed position, as shown in FIG. 5, the opposed lateral surfaces 30, 31 of the handle 16 reside substantially in vertical planes defined by the top and the bottom edges of each of the panels 14*a*–14*e*. To further secure the closed position, the first end 22*a* of the latch may be selectively secured to the second end of the latch 22*b*.

When it is desired to reopen the ring 18 and prepare the cup holder 10 for its next use, the user may simply undo the latch 22, move panels 14*a* and 14*b*, via hinges 12*a* and 12*c*, to pivot them away from the lateral surface 30 of the handle 16, and move panels 14*e* and 14*d*, via hinges 12*d* and 12*f*, to pivot them away from the lateral surface 31 of the handle 16. Such movements will expose the handle 16 as shown in FIG. 4. To complete the reopening process, the user may simply pull the longitudinal base of the handle 36 away from its opposing panel 14*c* to thereby open the ring 18.

Figure 6:
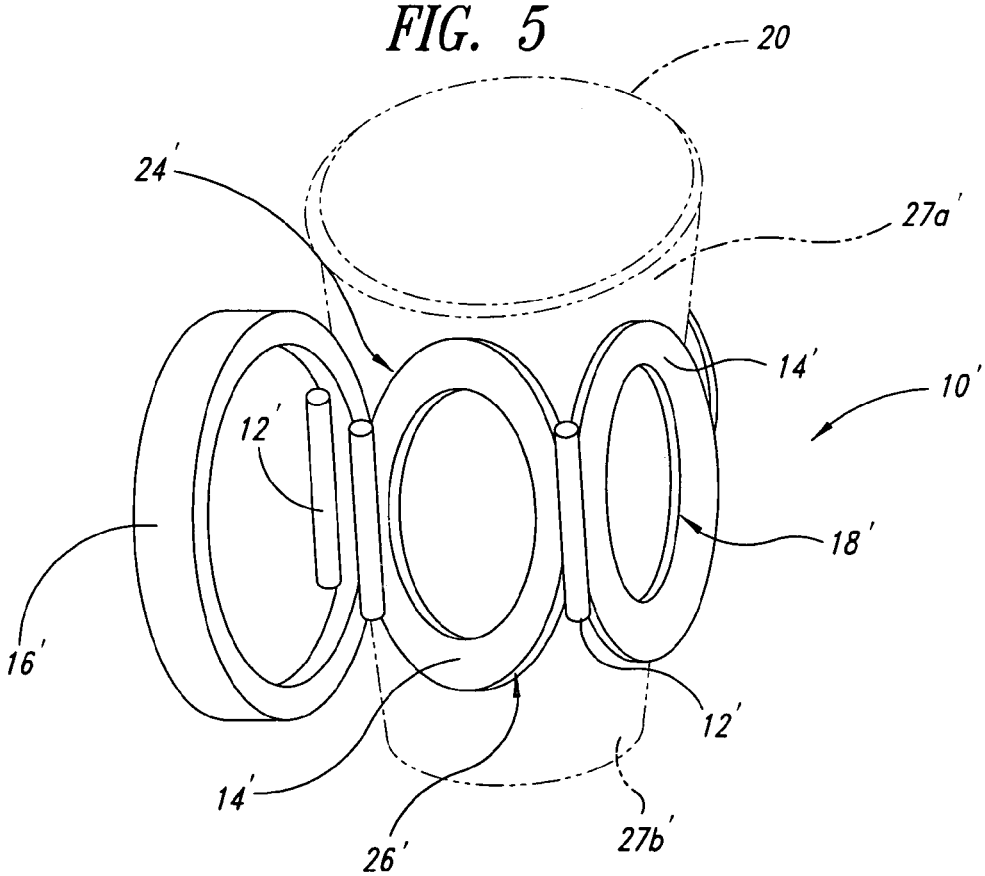
FIG. 6 is right front perspective view of a collapsible cup holder provided in accordance with another embodiment of the present invention.

FIG. 6 shows an alternative embodiment of the present invention generally indicated at reference number 10' in which similar structures with respect to the preferred embodiment are indicated with similar reference numerals including a prime symbol. In this embodiment, the panels 14' have an oval shape. The panels 14' and the handle 16' are intercoupled via projection-like hinges to form a ring 18'. As will be understood by one of ordinary skill in the art, projection-like hinges allow the panels 14' and handle 16' to pivot up to 180°. Further, the hinges 12' are substantially parallel to one another. To retain a disposable conical cup 20 within the ring 18', a top inner diameter 24' of the ring is substantially the same size as the bottom inner diameter 26' of the ring, and the ring's top and bottom inner diameter 24', 26' are preselected such that they are smaller than a top portion of the cup's circumferential outer wall 27'*a*.

As will be understood by one of ordinary skill in the art, the inner ring diameter 24', 26' of the alternative embodiment shown in FIG. 6 is best selected for use with a disposable conical cup 20 having a gradually increasing inner diameter, as measured from the bottom of the cup 20 to the top of the cup 20, such that: 1) a bottom portion of the circumferential outer wall of the cup 27'*b* is smaller than the inner diameter of the ring 24', 26' so that a predetermined portion of the cup's 20 length can reside within the ring 18', and 2) the top portion of the cup's 20 circumferential outer wall 27'*a* is larger than the inner diameter of the ring 24', 26' so that the larger top portion of the cup's circumferential outer wall 27'*a* makes contact with a portion of the inner diameter 24' of the ring 18' to restrain the cup 20 against further downward movement and thereby retain the cup 20 in the ring 18'.

Although FIG. 6 depicts parallel hinges 12' against the force of gravity in combination with oval, ornamental panels 14', it will be understood by those of ordinary skill in the art that the parallel hinges 12' of the alternative embodiment may be used in conjunction with a variety of other panel shapes, such as circular panels.

From the foregoing it will be appreciated that, although specific embodiments of the invention have been described herein for purposes of illustration, various modifications may be made without deviating from the spirit and scope of the invention. Accordingly, the invention is not to be limited except as by the appended claims.

What is claimed is:

1. A collapsible cup holder, comprising:

a rigid handle having a predetermined width;

first through fifth sequentially connected rigid panels, wherein the first and fifth panels are connected to the handle and have a substantially greater panel width than the predetermined width, the third panel having a panel width substantially equal to the predetermined handle width; and a plurality of hinges pivotally and sequentially intercoupling the connected panels and the handle to form a collapsible ring, the ring having an open position to receive a disposable cup and a closed position to reduce the size of the cup holder.

2. The collapsible cup holder of claim 1 wherein the hinges are living hinges.

3. The collapsible cup holder of claim 1 wherein the handle has a first side edge and a second side edge, with the first side edge being hingedly connected to the first panel and the second side edge being hingedly connected to the fifth panel.

4. The collapsible cup holder of claim 1 wherein each of the panels are polygonal and have parallel top and bottom edges, wherein the handle has opposed, parallel lateral surfaces residing substantially in vertical planes defined by the top and the bottom edges of each of the panels when the ring is in the closed position.

5. The collapsible cup holder of claim 3 wherein one of the panels has a latch adaptable to be positioned over a portion of the handle to releasably maintain the ring in the closed position.

6. The collapsible cup holder of claim 3 wherein the ring has a latch, the latch having a first end coupled to a first panel and a second end coupled to a second panel, the latch being selectively closable to maintain the ring in the closed position.

7. The collapsible cup holder of claim 1 wherein the first, second, fourth and fifth four panels have a trapezoidal shape and the third panel has a rectangular shape.

8. The collapsible cup holder of claim 1 wherein the ring has a top side and a bottom side, and an inner diameter of the top side is larger than an inner diameter of the bottom side when the ring is in the open position.

9. The collapsible cup holder of claim 1 wherein a plurality of the panels have an oval shape.

10. The collapsible cup holder of claim 1 wherein at least one of the panels has a wide and a flat surface for displaying a decorative feature.

11. A collapsible cup holder, comprising:

a nonfolding handle having a predetermined thickness;

five rigid panels pivotally connected to one another and to the handle defining a collapsible ring having an open position to receive and retain a disposable container, and a closed position to reduce the size of the holder; and wherein at least one of the rigid panels has a width substantially equal to the predetermined thickness of the handle to form a spine when the ring is in the closed position so that the ring can collapse about the handle with at least four of the panels being parallel to one another for compact storage.

12. The collapsible cup holder of claim 11 wherein the collapsible ring includes a latch positionable across a portion of the handle when the ring is in the closed position.

13. The collapsible cup holder of claim 11 wherein a plurality of hinges pivotally connect the panels to one another and to the handle, and when the ring is in an open position the hinges are skew to one another and a top inner diameter of the ring is larger than a bottom inner diameter of the ring.

14. A collapsible cup holder, comprising:

a handle having a longitudinal base having a predetermined lateral width, wherein the base has two edges;

first, second, third, and fourth rigid planar panels, each of the panels having two longitudinal edges, the first and the second panels each having one longitudinal edge pivotally connected to a respective one of the handle base edges, and the third and the fourth panels each having one edge pivotally connected to a respective remaining edge of the first and second panels; and a rigid spine panel having two parallel longitudinal edges, the spine panel having a width substantially equal to the predetermined width of the handle, wherein the spine panel edges are pivotally connected to remaining edges of the third and the fourth panels, such that the panels form a collapsible ring for receiving a disposable conical cup when the ring is an open position and wherein the panels are collapsible about the handle in book form.

15. The collapsible cup holder of claim 14 wherein the panels cover the edges of the handle when the panels are collapsed about the handle, whereby the third and fourth panels are adapted to receive and display advertising materials when the ring is in the collapsed position.

* * * * *